US007108338B2

(12) United States Patent
Katsuyama et al.

(10) Patent No.: US 7,108,338 B2
(45) Date of Patent: Sep. 19, 2006

(54) MULTI-PURPOSE STORAGE TABLE

(75) Inventors: Goro Katsuyama, Kanagawa-Ken (JP); Makoto Kurata, Kanagawa-Ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/158,054

(22) Filed: May 31, 2002

(65) Prior Publication Data

US 2002/0195915 A1 Dec. 26, 2002

(30) Foreign Application Priority Data

May 31, 2001 (JP) ..... 2001-164343
Apr. 30, 2002 (JP) ..... 2002-128035

(51) Int. Cl.
*A47B 88/00* (2006.01)

(52) U.S. Cl. ..... 312/301

(58) Field of Classification Search ..... 312/330.1, 312/107, 108, 334.23, 204, 291, 302, 223.1, 312/223.2, 294, 298, 301, 309, 310, 299, 312/304, 249.11; 280/33.998, 47.19
See application file for complete search history.

(56) References Cited

U.S. PATENT DOCUMENTS 128,439 A * 6/1872 Unna ..... 312/204
277,955 A * 5/1883 Stewart ..... 312/334.28
635,962 A * 10/1899 Henley ..... 312/273
839,992 A * 1/1907 Franke ..... 312/228
1,061,646 A * 5/1913 Welliver ..... 312/301
1,108,082 A * 8/1914 Pennock ..... 312/226
2,591,726 A * 4/1952 Schoen ..... 312/201
2,692,811 A * 10/1954 Page ..... 312/308
2,811,404 A * 10/1957 Brooks et al. ..... 312/122
3,241,850 A * 3/1966 Propst ..... 280/33.998
3,542,446 A * 11/1970 Joyce ..... 312/244
4,002,385 A * 1/1977 Hone ..... 312/286
4,026,616 A * 5/1977 Kuehl ..... 312/249.9
5,044,059 A * 9/1991 De Giulio ..... 29/401.1

(Continued)

FOREIGN PATENT DOCUMENTS

AU 12415 * 3/1929

(Continued)

*Primary Examiner*—James O. Hansen
(74) *Attorney, Agent, or Firm*—Oblon, Spivak, McClelland, Maier & Neustadt, P.C.

(57) ABSTRACT

A storage table 2 is composed of a cabinet 10 open to the front side of the image forming apparatus 1, and a tray 11 able to move into and out of the cabinet 10. The tray 11 includes a base plate 15 and a front cover 16. The base plate 26 is a flat part installed so that the base plate 26 can freely slide in and out of the cabinet 10 by the guide rails 13. The front cover 16 is assembled at a front end along an in-and-out direction of the base plate 26. The front cover 16 is integrally formed with a size covering the whole opening of the cabinet 10. The double-deck paper-loading unit 20 mounted on the storage table 2 has an upper tray 21 loaded on a lower tray 22, so that the lower tray 21 can move into and out of the cabinet 10 and the lower tray 21 is detachable to the base plate for altering the function of the storage table. The structure can be recombined to correspond to various functions, such as the storage of supplies, double-deck paper loading, tandem paper-loading etc, all using only one storage table, and so the cost can become cheaper.

7 Claims, 4 Drawing Sheets

U.S. PATENT DOCUMENTS

| | | | | | |
|---|---|---|---|---|---|
| 5,139,321 | A | * | 8/1992 | Beardsley | 312/209 |
| 5,322,365 | A | * | 6/1994 | Teufel et al. | 312/330.1 |
| 5,468,062 | A | * | 11/1995 | Finnegan | 312/301 |
| 6,086,176 | A | * | 7/2000 | Aoyama | 312/286 |
| 6,102,500 | A | * | 8/2000 | Chen | 312/223.2 |
| 6,123,344 | A | * | 9/2000 | Clegg | 280/47.19 |
| 6,304,739 | B1 | | 10/2001 | Katsuyama et al. | |
| 6,507,720 | B1 | | 1/2003 | Kabumoto et al. | |
| 6,519,436 | B1 | | 2/2003 | Katsuyama | |
| 6,532,352 | B1 | | 3/2003 | Katsuyama | |
| 6,549,744 | B1 | | 4/2003 | Terazawa et al. | |

FOREIGN PATENT DOCUMENTS

| | | | |
|---|---|---|---|
| CH | SW 159630 | * | 1/1933 |
| JP | 5-130920 | * | 5/1993 |
| JP | 5-221536 | | 8/1993 |
| JP | 9-121953 | * | 5/1997 |
| JP | 9-240897 | | 9/1997 |
| JP | 09-290933 | | 11/1997 |
| JP | 10-81422 | | 3/1998 |
| JP | 11-127998 | | 5/1999 |
| JP | 2000-044067 | | 2/2000 |

* cited by examiner

MULTI-PURPOSE STORAGE TABLE

CROSS-REFERENCE TO RELATED APPLICATION

This application claims the priority benefit of Japanese application serial no. 2001-164343, filed on May 31, 2002 and Japanese application serial no. 2002-128035, filed on Apr. 30, 2002.

BACKGROUND OF THE INVENTION

1. Field of the Invention

This invention relates in general to a multi-purpose storage table for a variety of applications. More particularly, the invention relates to multi-purpose storage table suitable for storing paper or samples for an image forming apparatus or its peripheral apparatuses.

2. Description of Related Art

For the image forming apparatus such as a copy machine, a facsimile, a printer, and a multi-functional machine having above functions, or the peripheral apparatus used together with the image formation apparatus, storage table is used in combination with the above apparatuses for the storage and the supply of the paper, or the storage of supplies.

Therefore, storage tables are made for specified purposes and applications. For example, a storage table could include a storage drawer having one or plural decks for storing paper or toner bottles, or a mechanism such as a paper-loading tray within the drawer for serving as a paper-loading table, or a paper-loading table having one or plural decks, or a tandem paper-feeding table such as a drawer having a pair of paper-loading units formed in a direction perpendicular to the in-and-out direction of the storage table. The maker of the image formation apparatus also manufactures and sells the above storage tables individually.

FIGS. 4A and 4B are perspective views of a conventional storage table with a double-deck paper-loading tray. As shown, the storage table 40 is composed of an upper and a lower (double-deck) paper-loading tray 41, 42 that are received in a cabinet 43, and the trays 41, 42 can be drawn out individually. Each of the upper tray 41 and the lower tray 42 has a front cover 44 and a storage unit 45.

However, regarding the storage table shown in FIG. 4, because the paper-loading trays 41, 42, including the front cover 44 etc, are independent of each other and have the same or similar structure, in considering a storage use other than flat objects such as paper, the respective storage space is too narrow and small, and therefore only objects with a thin thickness or a small volume can be stored therein. For example, if paper is loaded in one paper-loading tray 41, but the other paper-loading tray 42, where no paper is loaded, is not in use, it cannot be used for storing large objects, such as toner bottles. In addition, the table mentioned above is specified for each certain purpose. Therefore, the function of the table cannot be altered or changed to meet various usages after the table is purchased. Unavoidably, the user has to buy additional storage tables for various altered situations. In addition, because the use of the storage table is specified, the storage table cannot be made with smaller parts. Furthermore, because the material of the cabinet is metal plate, the manufacturing cost is very high.

SUMMARY OF THE INVENTION

According to the foregoing description, it is an object of the invention to provide a capability to store objects larger than the preset size. In addition, it is yet another object of the invention to provide a multi-purpose storage table, wherein the structure can be recombined to correspond to various functions, such as the storage of supplies, double-deck paper loading, tandem paper-loading etc, by using only one storage table, and so the cost can become cheaper.

According to the above objects, the invention provides a multi-purpose storage table, comprising a cabinet; a base plate, made of a flat part, and being assembled so that the base plate is capable of sliding on a bottom inside the cabinet and freely moves into and out of the cabinet; and a front cover, assembled at a front edge of the base plate in an in-and-out direction of the base plate.

The above storage unit is composed of a plurality of box units stacked on the base plate, the box units capable of moving into and out of the cabinet together with the base plate, and wherein in the storage unit, an upper box unit can slide through a lower box unit along the in-and-out direction of the base plate with respect to the cabinet.

In addition, except for the uppermost box unit among the box units, guide rails for sliding the upper box unit are formed on upper edges on each box unit along the in-and-out direction of the base plate with respect to the cabinet.

At least one of the box units is composed of a pair of boxes that is loaded on the base plate and arranged in a direction perpendicular to the in-and-out direction with respect to the cabinet, and is capable of moving into or out of the cabinet together with the base plate. Moreover, one of the boxes has a flat loading unit for loading the other box so as to be capable of sliding and moving along the in-and-out direction of the base plate with respect to the cabinet.

The flat loading unit mentioned above has a guiding unit for guiding the other box to move and slide along the in-and-out direction of the base plate with respect to the cabinet.

The invention further provides a multi-purpose storage table, comprising a cabinet; a base plate, made of a flat part, and being assembled so that the base plate is capable of sliding on a bottom inside the cabinet and freely moves into and out of the cabinet; and a front cover, assembled at a front edge of the base plate in an in-and-out direction of the base plate. A plurality of storage units is set to be capable of attaching on or detaching from the base plate.

The front cover entirely covers the front sides of the storage units in the in-and-out direction with respect to the cabinet.

In addition, except for the uppermost storage units among the storage units, guide rails for sliding an upper storage unit are formed on upper edges on each storage unit in the in-and-out direction of the base plate with respect to the cabinet.

At least one of the storage units is composed of a pair of box units that is loaded on the base plate and arranged in a direction perpendicular to the in-and-out direction with respect to the cabinet, and is capable of moving into or out of the cabinet together with the base plate. Moreover, one of the box units has a flat loading unit for loading the other box unit so as to be capable of sliding and moving along the in-and-out direction of the base plate with respect to the cabinet.

The flat loading unit has a guiding unit for guiding the other box unit to move and slide along the in-and-out direction of the base plate with respect to the cabinet.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1A:
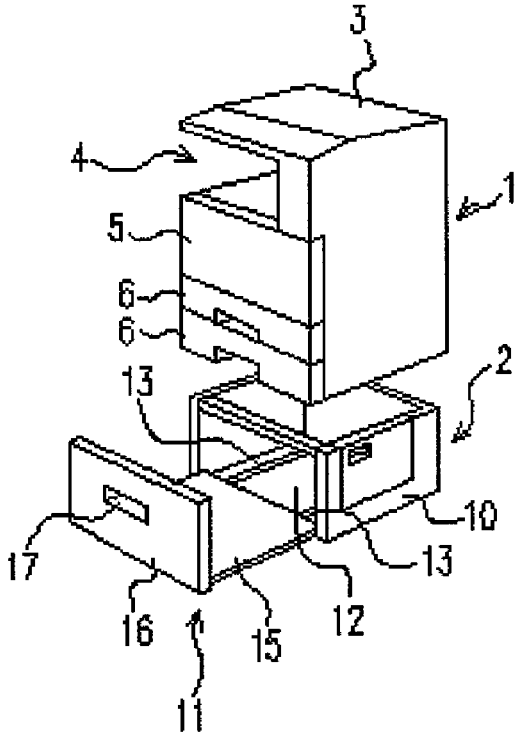
FIGS. 1A and 1B show a perspective view of an image formation apparatus using a multi-purpose storage table according to the first embodiment of the invention.
Figure 1B:
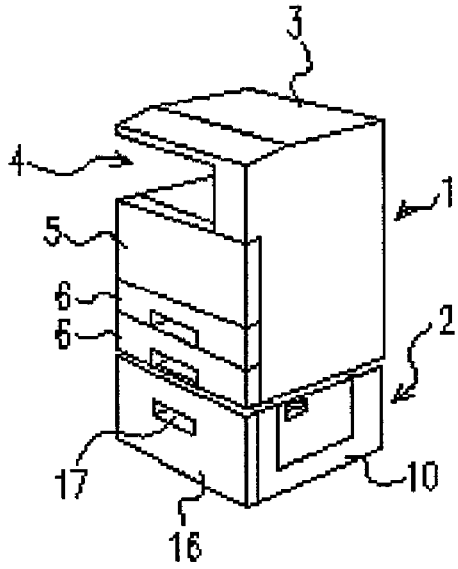

The following embodiments are described in detail in accordance to the drawings. FIGS. 1A and 1B show a perspective view of an image formation apparatus using a multi-purpose storage table according to the first embodiment of the invention. In FIGS. 1A and 1B, item 1 is the image formation apparatus and item 2 is the multipurpose storage table, which will be referred to as a storage table if not mentioned specially. The image formation apparatus 1 comprises an image reading unit 3, a paper-ejecting unit 4, an image formation unit 5 and a paper-loading unit 6 over the storage table 2, and fixed above the storage table 2 by such as screws. FIG. 1A shows a perspective view before the image formation apparatus is fixed onto the storage table 2, and FIG. 2 shows a perspective view after the image formation apparatus is fixed onto the storage table 2.

The storage table 2 is composed of a cabinet 10 that is open to the front side of the image forming apparatus 1, and a tray 11 capable of moving inside and outside the cabinet 10. Guide rails 13 capable of sliding the tray 11 into and out of the cabinet 10 are formed on a bottom surface 12 inside the cabinet 10.

The tray 11 is composed of a base plate 15 and a front cover 16 and thus forms a flat loading unit. The base plate 15 is a flat plate and is installed to make the base plate 15 capable of freely sliding in and out of the interior of the cabinet 10 by the guide rails 13. The front cover 16 is assembled at a front end along an in-out direction of the base plate 15. The front cover 16 is integrally formed and has a size that covers the whole opening of the cabinet 10, and additionally has a handle 17 formed thereon.

The storage table 2 having the above structure can load, receive or store paper, toner bottles or other so-called supply materials within a space divided by the inner walls of the cabinet 10 and the upper surface of the base plate 15. Because of the drawer type, the storage table 2 forms a structure where objects can be easily accessed even if they are positioned at the most inside portion of the cabinet 10.

Figure 2A:
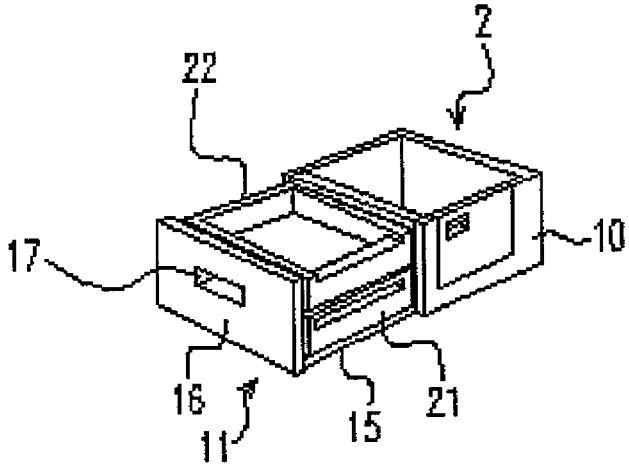
FIGS. 2A~2B show a perspective view of a multi-purpose table according to the second embodiment of the invention.
Figure 2B:
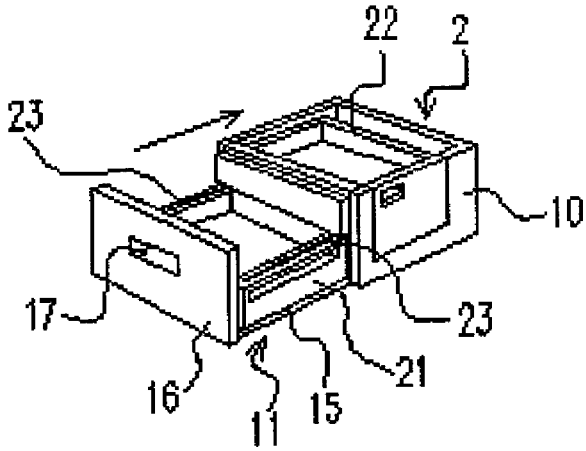
Figure 2C:
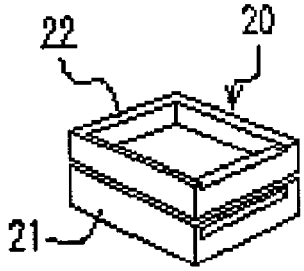
FIGS. 2C~2D show perspective views of double-deck paper-loading units mounted on the storage table 2 of the invention.
Figure 2D:
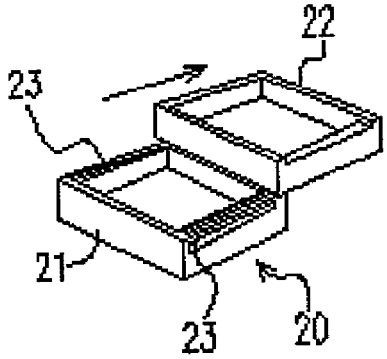

FIGS. 2A–2B show a perspective view of a multi-purpose table according to the second embodiment of the invention. FIGS. 2C–2D show perspective views of a double-deck paper-loading unit mounted on the storage table 2 of the invention. The double-deck paper-loading unit 20 of the embodiment is a structure such that an upper tray 22 is loaded on a lower tray 21. The upper and the lower trays 22, 21 have a projective shape that is substantially the same to the base plate 15. The lower tray 21 is loaded onto the base plate 15 and then fixed by such as screws, so that the lower tray 21 is detachable. In addition, the lower tray 21 can move freely into and out of the cabinet 10 as well as the storage stable 2.

The front cover 16 of the two trays 21, 22 is common, rather than respectively formed for each of the trays 21, 22. In addition, guide rails 23 for guiding the upper tray to slide are respectively arranged above two edges of the lower tray 21 in the in-and-out direction of the storage table 2. Therefore, by the handle 17 installed on the front cover 16 of the storage table 2, the two trays 21, 22 can be freely drawn into or out of the cabinet 10 together, as shown in FIG. 2A. Additionally, in the drawing out status, the upper tray 22 can be only slid into the cabinet 10, as shown in FIG. 2B. Feeding papers to the upper tray 22 is performed as shown in FIG. 2A, and feeding papers to the lower tray is performed as shown in FIG. 2B. Although omitted in the drawing, a driving unit for the double-deck paper-loading unit 20 can be arranged behind the unit 20 and the power supply can be connected to the image formation apparatus 1 and put in the cabinet 10 of the storage table 2, which are well-known structures that can be suitably adapted, and their corresponding descriptions are omitted. In addition, the withdrawing and drawing of the storage table 2 or the trays 21, 22, or the paper-loading process etc can be directly conducted even when the storage table 2 is still loaded in the image formation apparatus 1. Although double-deck trays are stacked in the drawing, three or more trays can be also stacked.

The storage table 2 in the second embodiment can alter its functions by detaching or attaching the paper-loading unit 20 according to various usages, even after the storage table 2 has been purchased. For example, if the storage table 2 is purchased to be used as a supply table for storing objects, afterwards the storage table 2 can be altered to a double-deck paper-loading table or a tandem paper-loading table. In addition, in such an altering process, the withdrawing and drawing of the storage table 2, or the detaching of the paper-loading unit 20, etc can be directly conducted even when the storage table 2 is still loaded in the image formation apparatus 1.

Figure 3A:
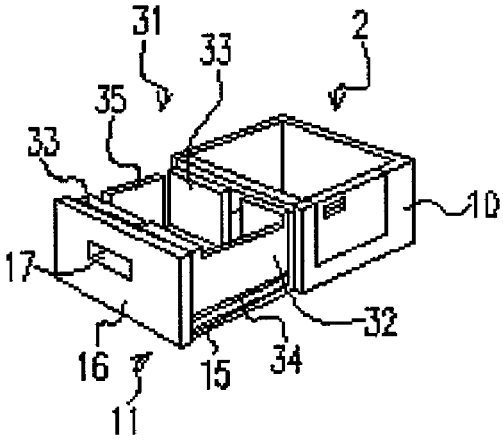
FIGS. 3A~3B show a perspective view of a multi-purpose table according to the third embodiment of the invention.
Figure 3B:
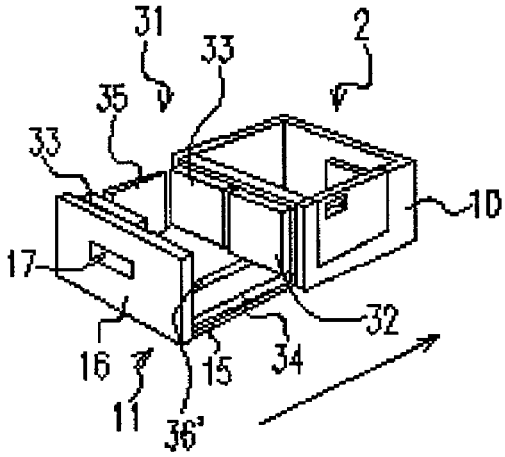
Figure 3C:
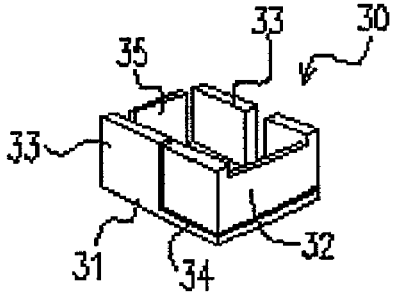
FIGS. 3C~3D show perspective views of a tandem paper-loading unit mounted on the storage table 2 of the invention.
Figure 3D:
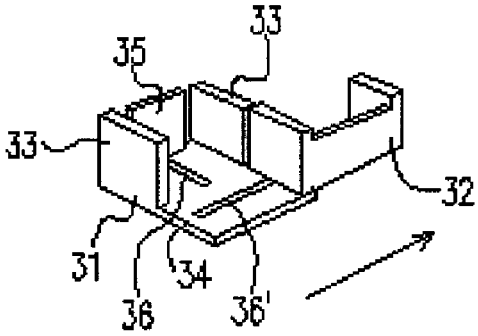
Figure 4A:
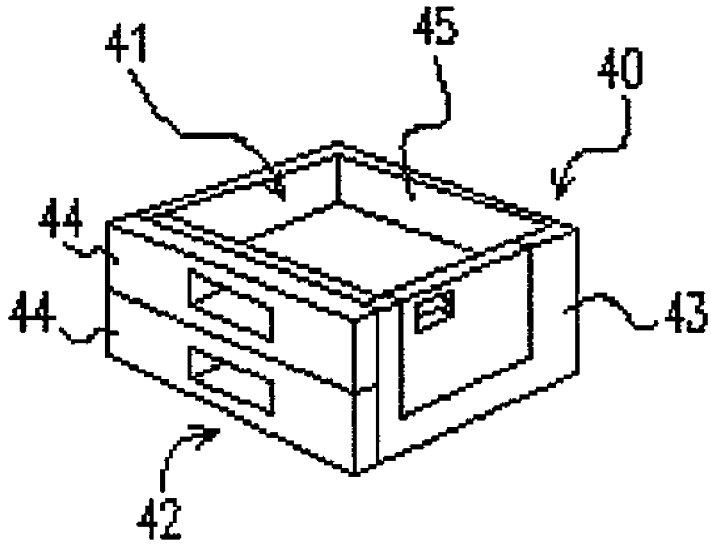
FIG. 4A(PRIOR ART)
FIGS. 4A and 4B are perspective views of a conventional storage table with a double-deck paper-loading tray.
Figure 4B:
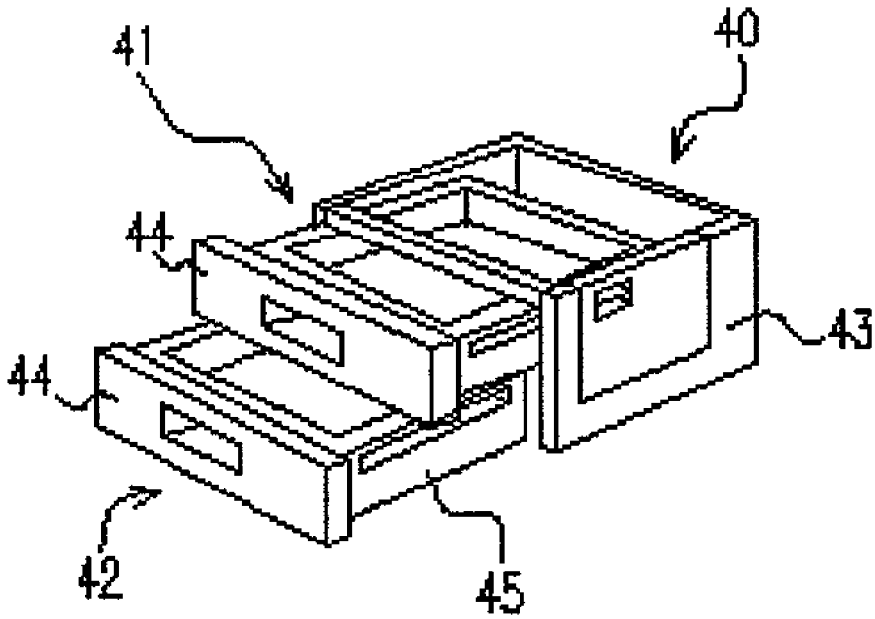
FIG. 4B(PRIOR ART)

FIGS. 3A~3B show a perspective view of a multi-purpose table according to the third embodiment of the invention. FIGS. 3C~3D show perspective views of a tandem paper-loading unit mounted on the storage table 2 of the invention. In the third embodiment, the tandem paper-loading unit 30 is constituted of a first tray 31 in which a second tray 32 is loaded. The first tray 31 has a projective shape that is substantially the same to the base plate 15, and is detachable because the first tray 31 is loaded onto the base plate 15 and then fixed by such as screws. In addition, the first tray 31 can move freely into and out of the cabinet 10 as well as the storage table 2. The second tray 32 has a bottom plate although it is not shown in the drawing.

The first tray 31 has three walls 33, 33, 35 to surround the edge of the base plate 15 at the left side of the drawing. The left side of the second tray 32 is open. The bottom plate 34 of the first tray 31 has a projective shape that is substantially the same as the base plate 15 and forms a flat loading unit. The second tray 32 is loaded on the right portion of the bottom plate 34 without assembling walls. The left wall 35 can slide through a guide rail (groove) 36 formed on the bottom plate 34 in a direction perpendicular to the in-and-out direction of the storage table 2. The second tray 32 slides through a guide rail or guiding unit (groove) 36' formed on the bottom plate 34 in and in-and-out direction of the storage table 2.

Therefore, by the handle 17 installed on the front cover 16 of the storage table 2, the two trays 31, 32 can be freely drawn into or out of the cabinet 10 together, as shown in FIG. 3A. Additionally, in the drawing out status, the second tray 32 can be only slid into the cabinet 10, as shown in FIG. 3B. Feeding papers to the second tray 32 is performed as shown in FIG. 3A, and feeding papers to the first tray is performed as shown in FIG. 3B. Changing the left wall 35 can adjust the paper bundle stored in the first tray 31.

In this embodiment, because the front cover 16 is common for a plurality of the storage units and the space can be altered optionally, the configuration is suitable to change for storing objects larger than the preset size.

Similar to the second embodiment, although omitted in the drawing, a driving unit for the tandem paper-loading unit 30 can be arranged behind the unit 30 and the power supply can be connected to the image formation apparatus 1 and put in the cabinet 10 of the storage table 2, which are well-known structures that can be suitably adapted, and their corresponding descriptions are omitted. In addition, the withdrawing and drawing of the storage table 2 or the trays 31, 32, or the paper-loading process etc can all be directly conducted even when the storage table 2 is still loaded in the image formation apparatus 1.

The storage table 2 in the third embodiment can alter its functions by detaching or attaching the paper-loading unit 30 according to various usages, even after the storage table 2 has been purchased. For example, if the storage table 2 is purchased to be used as a supply table for storing objects, afterwards the storage table 2 can be altered to a double-deck paper-loading table or a tandem paper-loading table.

As described above, the multi-purpose table of the invention can optionally attach or detach the double-deck paper-loading tray or the tandem paper-loading tray etc onto the base plate. Even after purchase, the configuration can be altered optionally to easily meet the requirements of the user.

In summary, according to the multi-purpose table of the invention, the front cover 16 of a plurality of storage units is common, rather than respectively formed for each of the storage units. Because the front cover is common in use, no matter what function is selected, the shapes of the cabinet, the base plate and the front cover do not need to be formed individually so that the material can be uniform and the packages for shipment can be uniform. By unifying the shape of the front cover, resources wasted in making the mold or disposing thereof can be reduced significantly. The cabinet etc, which is conventionally made of metal plate, can be made of resin to reduce the cost. Furthermore, it is not required to dispose of the cabinet due to the change of functions. Because only the unnecessary unit is disposed of during switching, the disposal cost can be reduced. Recycling becomes easy because the material of the cabinet is uniform.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. A multi-purpose storage table, comprising:

a cabinet;

a tray comprising a base plate assembled to a front cover extending upward from the base plate, the tray being without side and end walls and configured to move in and out of the cabinet, and the front cover having an exterior surface and an interior surface; and a storage unit comprising a plurality of box units including at least upper and lower box units stacked on the base plate, each of the upper and lower box units having a front, a back, and two sides, the front having an exterior surface, wherein the base plate is made of a flat part and is configured to slide in and out of the cabinet on a bottom portion thereof, the upper and lower box units are moveable in and out of the cabinet together with the base plate, the upper box unit is slidable with respect to the lower box unit along an in-and-out direction of the base plate, each of the upper and lower box units is positioned such that the exterior surface of the front thereof is covered by and in contact with the interior surface of the front cover when the base plate is slid in the cabinet and guide rails for sliding the upper box unit in the plurality of box units are formed on upper edges of the lower box unit in the plurality of box units alone the in-and-out direction of the base plate.

2. The multi-purpose storage table according to claim 1, wherein the front cover is integrally formed and has a size that covers an entire opening of the cabinet.

3. The multi-purpose storage table according to claim 1, wherein, the upper and lower box units are configured to be drawn in or out of the cabinet together.

4. A multi-purpose storage table, comprising:

a cabinet; and a tray comprising a base plate assembled to a front cover extending upward from the base plate, the tray being without side and end walls and configured to move in and out of the cabinet, the front cover having an exterior surface and an interior surface, wherein the base plate is made of a flat part and is configured to slide in and out of the cabinet on a bottom portion thereof, a plurality of storage units configured to be attached on or detached from the base plate, each of the plurality of storage units has a front, a back, and two sides, the front having an exterior surface, and each of the plurality of storage units is positioned such that the exterior surface of the front thereof is covered by and in contact with the interior surface of the front cover when the base plate is slid in the cabinet wherein guide rails for sliding an upper box unit in the plurality of storage units are formed on upper edges of a lower box unit in the plurality of storage units along the in-and-out direction of the base plate.

5. The multi-purpose storage table according to claim 4, wherein the front cover is integrally formed and has a size that covers an entire opening of the cabinet.

6. A multi-purpose storage table, comprising:

a cabinet;

a tray comprising a base plate assembled to a front cover extending upward from the base plate, the tray being without side and end walls and configured to move in and out of the cabinet, and the front cover having an exterior surface and an interior surface; and a storage unit comprising at least upper and lower box units stacked on the base plates each of the upper and lower box units having a front, a back, and two sides, the front having an exterior surface, wherein the base plate is made of a flat part and is configured to slide in and out of the cabinet on a bottom portion thereof, the upper and lower box units are moveable in and out of the cabinet together with the base plate, the upper box unit is slidable with respect to the lower box unit along an in-and-out direction of the base plate, and means for detachably fixing the lower box unit to the base plate.

7. A multi-purpose storage table, comprising:

a cabinet;

a tray comprising a base plate assembled to a front cover extending upward from the base plate, the tray being without side and end walls and configured is to move in and out of the cabinet, and the front cover having an exterior surface and an interior surface; and a storage unit comprising at least upper and lower box units stacked on the base plate, each of the upper and lower box units having a front, a back, and two sides, the front having an exterior surface, wherein the base plate is made of a flat part and is configured to slide in and out of the cabinet on a bottom portion thereof, the upper and lower box units are moveable in and out of the cabinet together with the base plate, the upper box unit is slidable with respect to the lower box unit along an in-and-out direction of the base plate; and when the tray is drawn out of the cabinet, the upper box unit is configured to slide in and out of the cabinet while the tray and the lower box unit remain drawn out of the cabinet.

* * * * *